US010392588B2

(12) United States Patent
Keuleers et al.

(10) Patent No.: US 10,392,588 B2
(45) Date of Patent: Aug. 27, 2019

(54) WATER-SOLUBLE UNIT DOSE ARTICLE COMPRISING A CYCLIC DIAMINE AND AN AMPHOTERIC SURFACTANT

(71) Applicant: The Procter & Gamble Company, Cincinnati, OH (US)

(72) Inventors: Robby Renilde Francois Keuleers, Lippelo (BE); Stefan Schittko, Overijse (BE); Alice Michele Boutoille, Brussels (BE); Nigel Patrick Somerville Roberts, Newcastle upon Tyne (GB); Alan Thomas Brooker, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 90 days.

(21) Appl. No.: 15/665,453

(22) Filed: Aug. 1, 2017

(65) Prior Publication Data

US 2018/0037858 A1 Feb. 8, 2018

(30) Foreign Application Priority Data

Aug. 4, 2016 (EP) ..... 16182692

(51) Int. Cl.

| | |
|---|---|
| ***C11D 17/04*** | (2006.01) |
| ***B65D 65/46*** | (2006.01) |
| ***C11D 1/94*** | (2006.01) |
| ***C11D 3/30*** | (2006.01) |
| ***C11D 1/83*** | (2006.01) |
| ***C11D 10/04*** | (2006.01) |
| *C11D 1/14* | (2006.01) |
| *C11D 1/24* | (2006.01) |
| *C11D 1/29* | (2006.01) |
| *C11D 1/72* | (2006.01) |
| *C11D 1/22* | (2006.01) |
| *C11D 1/75* | (2006.01) |

(52) U.S. Cl.

CPC ..... *C11D 17/043* (2013.01); *B65D 65/46* (2013.01); *C11D 1/83* (2013.01); *C11D 1/94* (2013.01); *C11D 3/30* (2013.01); *C11D 10/042* (2013.01); *C11D 10/045* (2013.01); *C11D 1/146* (2013.01); *C11D 1/22* (2013.01); *C11D 1/24* (2013.01); *C11D 1/29* (2013.01); *C11D 1/72* (2013.01); *C11D 1/75* (2013.01)

(58) Field of Classification Search

CPC ..... C11D 17/042; C11D 1/12; C11D 1/22; C11D 1/29; C11D 1/75; C11D 1/83; C11D 3/30

See application file for complete search history.

(56) References Cited

U.S. PATENT DOCUMENTS

| | | | | |
|---|---|---|---|---|
| 8,309,505 | B2 * | 11/2012 | Fossum | C11D 3/0052 510/235 |
| 2003/0213500 | A1 * | 11/2003 | Mangin | A47L 17/00 134/6 |
| 2004/0063598 | A1 | 4/2004 | Riebe | |
| 2004/0142841 | A1 | 7/2004 | De Buzzaccarini | |
| 2011/0257070 | A1 * | 10/2011 | Caggioni | C11D 3/222 510/418 |
| 2012/0077725 | A1 * | 3/2012 | Wang | C11D 3/227 510/285 |
| 2012/0208737 | A1 * | 8/2012 | Caggioni | C11D 3/222 510/418 |
| 2015/0329807 | A1 | 11/2015 | Naqvi | |
| 2015/0361381 | A1 * | 12/2015 | Ebert | C11D 1/662 510/218 |
| 2016/0040105 | A1 | 2/2016 | Depoot | |
| 2016/0108340 | A1 * | 4/2016 | Feng | A61Q 15/00 512/4 |

OTHER PUBLICATIONS

EP Search Report, Application No. 16182692.0-1358, dated Nov. 28, 2016.

PCT Search Report for appl No. PCT/US2017/044582, dated Sep. 19, 2017, 14 pgs.

* cited by examiner

*Primary Examiner* — Charles I Boyer

(74) *Attorney, Agent, or Firm* — Gregory S. Darley-Emerson

(57) ABSTRACT

The present invention relates to water-soluble unit dose articles comprising an amphoteric surfactant, methods of making and methods of use.

14 Claims, 1 Drawing Sheet

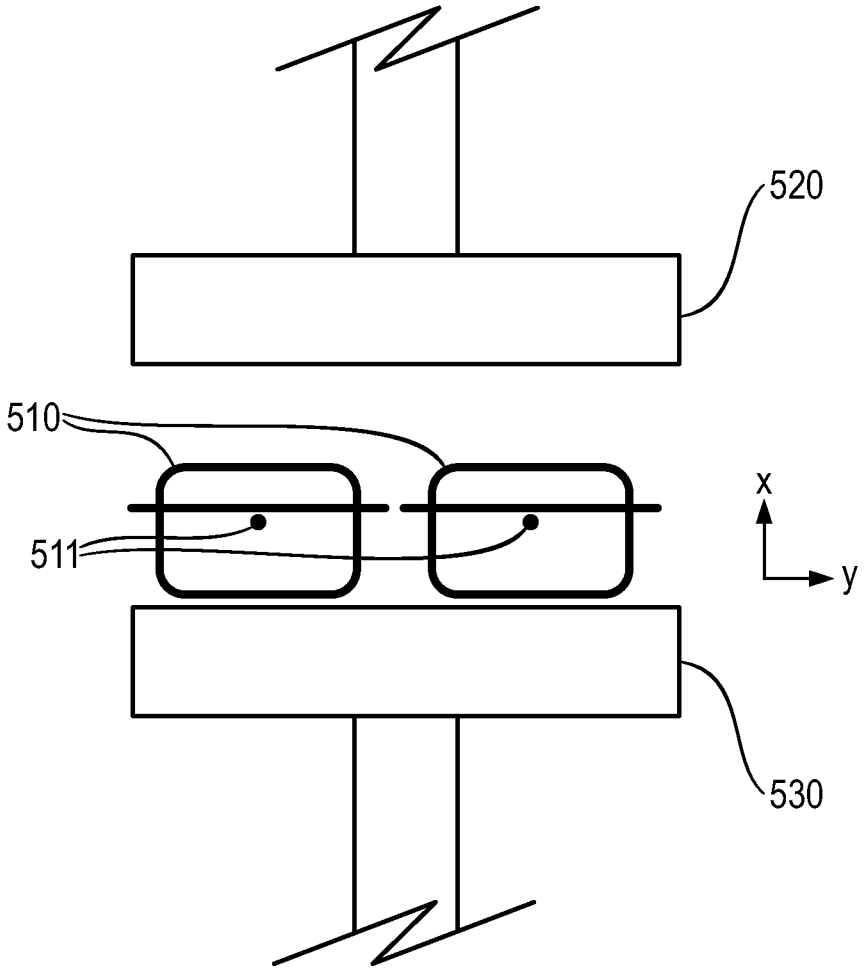
520
510
511
x
y
530

WATER-SOLUBLE UNIT DOSE ARTICLE COMPRISING A CYCLIC DIAMINE AND AN AMPHOTERIC SURFACTANT

FIELD OF THE INVENTION

The present invention relates to water-soluble unit dose articles comprising an amphoteric surfactant, methods of making and methods of use.

BACKGROUND OF THE INVENTION

Water-soluble unit dose articles are liked by consumers due their convenience and ease of use. Consumers also like the fact that they do not need to measure a detergent dose and so this eliminates accidental spillage during the dosing operation. Accidental dosage can be messy and inconvenient.

An issue with water-soluble unit dose articles though is the possibility of premature rupture prior to use. Especially wherein the detergent composition is a liquid this can result in spillage and mess both in the storage container and during the dosage operation. Furthermore, spillage within the container can result in contamination of neighboring unit dose articles meaning their use is also messy and inconvenient and not just that of the ruptured unit dose article.

In order to reduce the volume of leakage from a ruptured unit dose article, the viscosity of the liquid detergent composition can be increased. However, such viscosity increase requires the use of rheology modifiers. These provide no cleaning active benefit and serve only to increase the viscosity. This can be problematic in a water-soluble unit dose article where there is limited space for formulation of ingredients. Hence addition of a rheology modifier can negatively impact cleaning performance due to resultant lower levels of cleaning actives in order to make space for formulation of the rheology modifier.

Hence there is a need in the art for a water-soluble unit dose article that provides excellent or even improved cleaning performance yet exhibits minimized liquid detergent volume leakage from prematurely ruptured unit dose articles.

It was surprisingly found that a water-soluble unit dose article comprising a liquid detergent composition wherein the liquid detergent composition comprises an amphoteric surfactant solved the above technical problem.

SUMMARY OF THE INVENTION

The present invention discloses a water-soluble unit dose article comprising a water-soluble film and a liquid laundry detergent composition, wherein the liquid laundry detergent composition comprises a non-soap anionic surfactant and an amphoteric surfactant.

A second aspect of the present invention is a packaged product comprising a reclosable container and at least one water-soluble unit dose article according to the present invention comprised therein.

A third aspect of the present invention is the use of an amphoteric surfactant in a liquid detergent composition comprised within a water-soluble unit dose article according to the present invention to provide excellent grease cleaning benefits and reduced liquid leakage from prematurely ruptured unit dose articles.

A fourth aspect of the present invention is a method of making a water-soluble unit dose article according to the present invention, wherein the liquid laundry detergent composition is prepared by preparing a base composition comprising the non-soap anionic surfactant and adding the amphoteric surfactant to said base composition, wherein the amphoteric surfactant is added in the form of a powder or a premix wherein said premix comprises the amphoteric surfactant and a non-aqueous solvent preferably selected from alcohols, polyols, glycols or a mixture thereof.

BRIEF DESCRIPTION OF THE DRAWINGS

FIG. 1 depicts a schematic illustration of the basic configuration of the liquid detergent release test.

DETAILED DESCRIPTION OF THE INVENTION

Water-Soluble Unit Dose Article

The present invention discloses a water-soluble unit dose article comprising a water-soluble film and a liquid laundry detergent composition. The water-soluble film and the liquid detergent composition are described in more detail below.

The water-soluble unit dose article comprises the water-soluble film shaped such that the unit-dose article comprises at least one internal compartment surrounded by the water-soluble film. The unit dose article may comprise a first water-soluble film and a second water-soluble film sealed to one another such to define the internal compartment. The water-soluble unit dose article is constructed such that the detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the detergent composition. During manufacture, a first water-soluble film may be shaped to comprise an open compartment into which the detergent composition is added. A second water-soluble film is then laid over the first film in such an orientation as to close the opening of the compartment. The first and second films are then sealed together along a seal region.

The unit dose article may comprise more than one compartment, even at least two compartments, or even at least three compartments. The compartments may be arranged in superposed orientation, i.e. one positioned on top of the other. In such an orientation the unit dose article will comprise three films, top, middle and bottom. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the detergent composition according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms.

The water-soluble unit dose article may comprise at least two internal compartments, wherein the liquid laundry detergent composition is comprised in at least one of the compartments, preferably wherein the unit dose article comprises at least three compartments, wherein the detergent composition is comprised in at least one of the compartments.

Water-Soluble Film

The film of the present invention is soluble or dispersible in water. The water-soluble film preferably comprises polyvinyl alcohol or a copolymer thereof. Preferably, the water-soluble film comprises a blend of at least two different polyvinylalcohol homopolymers, at least two different polyvinylalcohol copolymers, at least one polyvinylalcohol homopolymer and at least one polyvinylalcohol copolymer or a combination thereof.

Preferably, the water-soluble film has a thickness between 50 microns and 100 microns, preferably between 70 microns and 90 microns before being deformed into a unit dose article.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a preweighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Preferably, the water-soluble unit dose article comprises polyvinylalcohol.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol.

Preferred for use herein are PVA polymers which are from about 60% to about 98% hydrolysed, preferably about 80% to about 90% hydrolysed, to improve the dissolution characteristics of the material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol.

Of the total PVA resin content in the film described herein, the PVA resin can comprise about 30 to about 85 wt % of the first PVA polymer, or about 45 to about 55 wt % of the first PVA polymer. For example, the PVA resin can contain about 50 w. % of each PVA polymer, wherein the viscosity of the first PVA polymer is about 13 cP and the viscosity of the second PVA polymer is about 23 cP, measured as a 4% polymer solution in demineralized water at 20° C.

Preferably the film comprises a blend of at least two different polyvinylalcohol homopolymers and/or copolymers.

Most preferably the water soluble film comprises a blend of at least two different polyvinylalcohol homopolymers, especially a water soluble film comprising a blend of at least two different polyvinylalcohol homopolymers of different average molecular weight, especially a blend of 2 different polyvinylalcohol homopolymers having an absolute average viscosity difference $|\mu_2-\mu_1|$ for the first PVOH homopolymer and the second PVOH homopolymer, measured as a 4% polymer solution in demineralized water, in a range of 5 cP to about 15 cP, and both homopolymers having an average degree of hydrolysis between 85% and 95% preferably between 85% and 90%. The first homopolymer preferably has an average viscosity of 10 to 20 cP preferably 10 to 15 cP The second homopolymer preferably has an average viscosity of 20 to 30 cP preferably 20 to 25 cP. Most preferably the two homopolymers are blended in a 40/60 to a 60/40 weight % ratio.

Alternatively the water soluble film comprises a polymer blend comprising at least one copolymer comprising polyvinylalcohol and anionically modified monomer units. In particular the polymer blend might comprise a 90/10 to 50/50 weight % ratio of a polyvinylalcohol homopolymer and a copolymer comprising polyvinylalcohol and anionically modified monomer units. Alternatively the polymer blend might comprise a 90/10 to 10/90 weight % ratio of two different copolymers comprising polyvinylalcohol and anionically modified monomer units.

General classes of anionic monomer units which can be used for the PVOH corpolymer include the vinyl polymerization units corresponding to monocarboxylic acid vinyl monomers, their esters and anhydrides, dicarboxylic monomers having a polymerizable double bond, their esters and anhydrides, vinyl sulfonic acid monomers, and alkali metal salts of any of the foregoing. Examples of suitable anionic monomer units include the vinyl polymerization units corresponding to vinyl anionic monomers including vinyl acetic acid, maleic acid, monoalkyl maleate, dialkyl maleate, monomethyl maleate, dimethyl maleate, maleic anyhydride, fumaric acid, monoalkyl fumarate, dialkyl fumarate, monomethyl fumarate, dimethyl fumarate, fumaric anyhydride, itaconic acid, monomethyl itaconate, dimethyl itaconate, itaconic anhydride, vinyl sulfonic acid, allyl sulfonic acid, ethylene sulfonic acid, 2-acrylamido-1-methylpropanesulfonic acid, 2-acrylamido-2-methylpropanesulfonic acid, 2-methylacrylamido-2-methylpropanesulfonic acid, 2-sulfoethyl acrylate, alkali metal salts of the foregoing (e.g., sodium, potassium, or other alkali metal salts), esters of the foregoing (e.g., methyl, ethyl, or other $C_1$-$C_4$ or $C_6$ alkyl esters), and combinations thereof (e.g., multiple types of anionic monomers or equivalent forms of the same anionic monomer). In an aspect, the anionic monomer can be one or more acrylamido methylpropanesulfonic acids (e.g., 2-acrylamido-1-methylpropanesulfonic acid, 2-acrylamido-2-methylpropanesulfonic acid, 2-methylacrylamido-2-methylpropanesulfonic acid), alkali metal salts thereof (e.g., sodium salts), and combinations thereof. In an aspect, the anionic monomer can be one or more of monomethyl maleate, alkali metal salts thereof (e.g., sodium salts), and combinations thereof.

The level of incorporation of the one or more anionic monomer units in the PVOH copolymers is not particularly limited. In some aspects, the one or more anionic monomer units are present in a PVOH copolymer in an amount in a range of about 2 mol. % to about 10 mol. % (e.g., at least 2.0, 2.5, 3.0, 3.5, or 4.0 mol. % and/or up to about 3.0, 4.0, 4.5, 5.0, 6.0, 8.0, or 10 mol. % in various embodiments), individually or collectively.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, dipropylene glycol, sorbitol and mixtures thereof. Other additives may include water and functional detergent additives, including surfactant, to be delivered to the wash water, for example organic polymeric dispersants, etc.

The film may be opaque, transparent or translucent. The film may comprise a printed area. The printed area may cover between 10% and 80% of the surface of the film; or between 10% and 80% of the surface of the film that is in contact with the internal space of the compartment; or between 10% and 80% of the surface of the film and between 10% and 80% of the surface of the compartment.

The area of print may cover an uninterrupted portion of the film or it may cover parts thereof, i.e. comprise smaller areas of print, the sum of which represents between 10% and 80% of the surface of the film or the surface of the film in contact with the internal space of the compartment or both.

The area of print may comprise inks, pigments, dyes, blueing agents or mixtures thereof. The area of print may be opaque, translucent or transparent.

The area of print may comprise a single colour or maybe comprise multiple colours, even three colours. The area of print may comprise white, black, blue, red colours, or a mixture thereof. The print may be present as a layer on the surface of the film or may at least partially penetrate into the film. The film will comprise a first side and a second side. The area of print may be present on either side of the film, or be present on both sides of the film. Alternatively, the area of print may be at least partially comprised within the film itself.

The area of print may comprise an ink, wherein the ink comprises a pigment. The ink for printing onto the film has preferably a desired dispersion grade in water. The ink may be of any color including white, red, and black. The ink may be a water-based ink comprising from 10% to 80% or from 20% to 60% or from 25% to 45% per weight of water. The ink may comprise from 20% to 90% or from 40% to 80% or from 50% to 75% per weight of solid.

The ink may have a viscosity measured at 20° C. with a shear rate of 1000 $s^{-1}$ between 1 and 600 cPs or between 50 and 350 cPs or between 100 and 300 cPs or between 150 and 250 cPs. The measurement may be obtained with a cone-plate geometry on a TA instruments AR-550 Rheometer.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either or both sides of the film.

Alternatively, an ink or pigment may be added during the manufacture of the film such that all or at least part of the film is coloured.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 ppm.

Liquid Laundry Detergent Composition

The water-soluble unit dose article comprises a liquid laundry detergent composition. The term 'liquid laundry detergent composition' refers to any laundry detergent composition comprising a liquid capable of wetting and treating a fabric, and includes, but is not limited to, liquids, gels, pastes, dispersions and the like. The liquid composition can include solids or gases in suitably subdivided form, but the liquid composition excludes forms which are non-fluid overall, such as tablets or granules.

The liquid detergent composition can be used in a fabric hand wash operation or may be used in an automatic machine fabric wash operation.

The liquid laundry detergent composition comprises a non-soap anionic surfactant and an amphoteric surfactant.

Preferably, the amphoteric surfactant is amine oxide. More preferably, the amine oxide is selected from $C_{12-14}$ dimethyl amine oxide or $C_{12-14}$ amido propyl dimethyl amine oxide, preferably $C_{12-14}$ dimethyl amine oxide, most preferably linear $C_{12-14}$ dimethyl amine oxide.

Typical linear amine oxides include water-soluble amine oxides containing one R1 $C_{8-18}$ alkyl moiety and 2 R2 and R3 moieties selected from the group consisting of $C_{1-3}$ alkyl groups and $C_{1-3}$ hydroxyalkyl groups. Preferably amine oxide is characterized by the formula R1-N(R2)(R3) O wherein $R_1$ is a $C_{8-18}$ alkyl and $R_2$ and $R_3$ are selected from the group consisting of methyl, ethyl, propyl, isopropyl, 2-hydroxethyl, 2-hydroxypropyl and 3-hydroxypropyl, preferably methyl. The linear amine oxide surfactants in particular may include linear Cm-Cis alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides, most preferably linear C12-14 alkyl dimethyl amine oxide.

As used herein "mid-branched" means that the amine oxide has one alkyl moiety having $n_1$ carbon atoms with one alkyl branch on the alkyl moiety having $n_2$ carbon atoms. The alkyl branch is located on the a carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The most preferred amine oxide comprises at least 50 wt %, preferably at least 60 wt %, more preferably at least 75 wt % to 100 wt % of linear C12-C14 alkyl dimethyl amine oxide by weight of the amine oxide surfactant.

Preferably, the liquid laundry detergent composition comprises from 0.01% to 20%, preferably from 0.2% to 15%, more preferably from 0.5% to 10%, most preferably from 1% to 5% by weight of the liquid detergent composition of the amphoteric surfactant.

The non-soap anionic surfactant may be selected from linear alkylbenzene sulphonate, alkyl sulphate, alkoxylated alkyl sulphate or a mixture thereof. Preferably, the non-soap anionic surfactant comprises linear alkylbenzene sulphonate and alkoxylated alkyl sulphate. Preferably, the weight ratio of linear alkylbenzene sulphonate to alkoxylated alkyl sulphate is from 2:1 to 1:8 preferably from 1:1 to 1:5 most preferably from 1:1.25 to 1:4.

The liquid laundry detergent composition may comprise between 5% and 45%, preferably between 10% and 40%, more preferably between 15% and 35%, most preferably between 20% and 30% by weight of the liquid detergent composition of the non-soap anionic surfactant.

The liquid laundry detergent composition may comprise between 5% and 35%, preferably between 5% and 20%, more preferably between 5% and 15% by weight of the liquid laundry detergent composition of the non-soap anionic surfactant.

The liquid laundry detergent composition may comprise a non-ionic surfactant. Preferably, the non-ionic surfactant is selected from a fatty alcohol alkoxylate, an oxo-synthesised fatty alcohol alkoxylate, Guerbet alcohol alkoxylates, alkyl phenol alcohol alkoxylates or a mixture thereof.

The liquid laundry detergent composition may comprise between 1% and 25%, preferably between 1.5% and 20%, most preferably between 2% and 15% by weight of the liquid laundry detergent composition of the non-ionic surfactant.

Preferably, the weight ratio of non-soap anionic surfactant to non-ionic surfactant is from 1:1 to 20:1, preferably from 1.3:1 to 15:1, more preferably from 1.5:1 to 10:1.

The liquid detergent composition comprises between 1% and 25%, preferably between 1.5% and 20%, more preferably between 1% and 25%, preferably between 1.5% and 20%, most preferably between 2% and 15% by weight of the liquid detergent composition of soap.

The liquid laundry detergent composition may comprise a cyclic diamine of Formula (I):

(I)

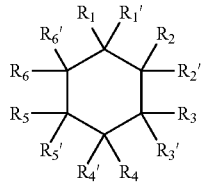

wherein two of the Rs, are selected from the group consisting of NH2, (C1-C4)NH2 and mixtures thereof and the remaining Rs are independently selected from H, linear or branched alkyl or alkenyl having from 1 to 10 carbon atoms.

The term "cyclic diamine" herein encompasses a single cleaning amine and a mixture thereof. The amine can be subjected to protonation depending on the pH of the cleaning medium in which it is used.

The amine of Formula (I) is a cyclic amine with two primary amine functionalities. The primary amines can be in any position in the cycle but it has been found that in terms of grease cleaning, better performance can be obtained when the primary amines are in positions 1,3. It has also been found advantageous in terms of grease cleaning amines in which one of the substituents is —CH3 and the rest are H.

Preferably the 'remaining Rs' of Formula I, are selected from H, CH3 and mixtures thereof.

With respect to Formula I, the two Rs selected from the group consisting of NH2, (C1-C4)NH2 and mixtures thereof are preferably in positions R1 and R3 of Formula I.

The cyclic diamine may be selected from the group consisting of:

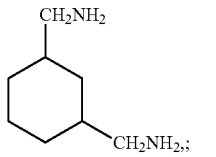

1, 3-bis(methylamine)-cyclohexane

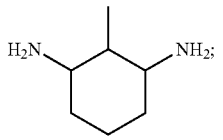

2-methylcyclohexane-1,4-diamine

-continued

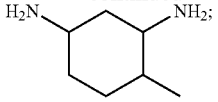

4-methylcyclohexane-1,4-diamine

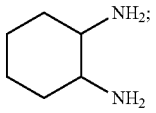

Cyclohexane-1,2-diamine

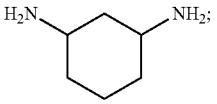

Cyclohexane-1,3-diamine

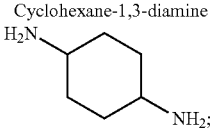

Cyclohexane-1,4-diamine

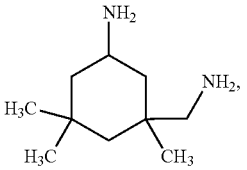

Isophoronediamine and a mixture thereof.

The cyclic diamine is selected from the group consisting of 1, 3-bis(methylamine)-cyclohexane, 2-methylcyclohexane-1,3-diamine, 4-methylcyclohexane-1,3-diamine and mixtures thereof.

The liquid detergent composition may comprise from 0.1% to 5%, preferably from 0.1% to 2% by weight of the liquid detergent composition of the cyclic diamine.

The liquid detergent composition may comprise a non-aqueous solvent. The non-aqueous solvent maybe selected from the group comprising polyethylene glycol (PEG) polymer having molecular weight between 300 and 600, dipropylene glycol (DPG), nbutoxy propoxy propanol (nBPP), 1,2-propanediol, 1,3-propanediol, glycerol, ethanol and mixtures thereof, preferably wherein the non-aqueous solvent maybe selected from the group comprising dipropylene glycol (DPG), nbutoxy propoxy propanol (nBPP), 1,2-propanediol, glycerol, and mixtures thereof.

The liquid laundry detergent composition may comprise a cleaning or care polymer, preferably wherein the cleaning or care polymer is selected from an ethoxylated polyethyleneimine, alkoxylated polyalkyl phenol, an amphiphilic graft copolymer, a polyester terephthalate, a hydroxyethylcellulose, a carboxymethylcellulose or a mixture thereof.

The water-soluble unit dose article may comprise an adjunct ingredient selected from hueing dyes, polymers, builders, dye transfer inhibiting agents, dispersants, enzymes, enzyme stabilizers, catalytic materials, bleach, bleach activators, polymeric dispersing agents, anti-redeposition agents, suds suppressors, aesthetic dyes, opacifiers, perfumes, perfume delivery systems, structurants, hydrotropes, processing aids, pigments and mixtures thereof.

Preferably, the liquid laundry detergent composition is non-Newtonian. Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate.

The liquid laundry detergent composition may have a viscosity of at least 2 Pa·s at a shear rate of 0.5 $s^{-1}$ as measured using a TA Rheometer AR2000 at 25° C., preferably wherein the liquid detergent composition has a viscosity of between 2 Pa·s and 35 Pa·s, preferably between 2.5 Pa·s and 30 Pa·as, more preferably between 3 Pa·s and 25 Pa·s, even more preferably between 5 Pa·s and 20 Pa·s, most preferably between 10 Pa·s and 16 Pa·s at a shear rate of 0.5 $s^{-1}$ as measured using a TA Rheometer AR2000 at 25° C.

Method of Making

Those skilled in the art will know how to make the unit dose article and liquid laundry detergent composition of the present invention using known techniques in the art.

A further aspect of the present invention is a method making a water-soluble unit dose article according to the present invention, wherein the liquid laundry detergent composition is prepared by preparing a base composition comprising the non-soap anionic surfactant and adding the amphoteric surfactant to said base composition, wherein the amphoteric surfactant is added;

a. in the form of a powder; or
b. a premix wherein said premix comprises the amphoteric surfactant and a non-aqueous solvent preferably selected from alcohols, polyols, glycols; or
c. a mixture thereof.

The amphoteric surfactant-non-aqueous solvent premix preferably is substantially non-aqueous i.e. preferably comprising less than 20% more preferable less than 10% most preferably less than 5% of water. This premix preferably comprises at least 10% preferably at least 20% more preferably at least 30% by weight of the premix of the amphoteric surfactant. The premix may comprise at most 35%, preferably, 40%, more preferably 50%, even more preferably 60% by weight of the premix of the amphoteric surfactant.

Without wishing to be bound by theory, in order to control water level inside the unit dose article, amine oxide preferably is added as a substantially non-aqueous material or premix, i.e. it can be added as a dried substantially 100% active powder or can be pre-dissolved or pre-dispersed in an organic solvent, whereby the organic solvent does not substantially affect the film hence unit dose article strength and integrity.

Method of Washing

A further aspect of the present invention is a method of washing comprising the steps of adding the water-soluble unit dose article according to the present invention to sufficient water to dilute the liquid detergent composition by a factor of at least 300 fold to create a wash liquor and contacting items to be washed with said wash liquor.

Packaged Product

A further aspect of the present invention is a packaged product comprising a reclosable container and at least one water-soluble unit dose article according to the present invention comprised therein.

Those skilled in the art will be aware of relevant storage receptacles. Preferably, the storage receptacle is a flexible, preferably resealable, bag, a rigid, preferably reclosable, tub or a mixture thereof, preferably, wherein the storage receptacle comprises a child resistant closure. Those skilled in the art will be aware of suitable child resistant closures.

The package may be made from any suitable material. The container may be made from metallic materials, Aluminium, plastic materials, cardboard materials, laminates, cellulose pulp materials or a mixture thereof. The package may be made from a plastic material, preferably a polyolefin material. The package may be made from polypropylene, polystyrene, polyethylene, polyethylene terephthalate, PVC or a mixture thereof or more durable engineering plastics like Acrylonitrile Butadiene Styrene (ABS), Polycarbonates, Polyamides and the like The material used to make the container may comprise other ingredients, such as colorants, preservatives, plasticisers, UV stabilizers, Oxygen, perfume and moisture barriers recycled materials and the like.

Use

A further aspect of the present invention is the use of an amphoteric surfactant in a liquid detergent composition comprised within a water-soluble unit dose article according to the present invention to provide excellent grease cleaning benefits and reduced liquid leakage from prematurely ruptured unit dose articles.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

EXAMPLES

The following detergent compositions were prepared using standard mixing techniques:

TABLE 1

| ingredient [wt %] | reference | Example A |
|---|---|---|
| water | 9.36 | 9.34 |
| citric acid | 0.65 | 0.66 |
| 1,2 propanediol | 15.1 | 13.8 |
| monoethanolamine | 8.4 | 7.6 |
| glycerol | 5 | 5 |
| hydroxyethyldiphosphonic acid (HEDP) | 2 | 2 |
| nonionic surfactant C1214 EO7 | 14.5 | 14.5 |
| HLAS | 18.4 | 18.4 |
| Topped Palm Kernel Fatty Acid | 6 | 6 |
| C1214AE3S anionic surfactant | 8.77 | 8.77 |
| ethoxylated polyethyleneimine polymer (PEI600EO20) | 5.3 | 5.3 |
| MgCl2 | 0.3 | 0.3 |
| perfume | 2.4 | 2.4 |
| PEG-Vinyl Acetate co-polymer | 1.7 | 1.7 |

TABLE 1-continued

| ingredient [wt %] | reference | Example A |
|---|---|---|
| C1214 dimethyl amine oxide (AO) | 0 | 2 |
| Minors | Up to 100% | Up to 100% |

Single compartment water soluble unit dose articles with a 50*50 mm footprint, cavity depth of 20.79 mm and cavity volume of 34 ml were prepared through thermo/vacuum forming and filled with the above compositions. M8630 water-soluble film, as commercially available from the Monosol company was used.

The reference unit dose article comprising the reference detergent composition was outside the scope of the present invention. Unit dose article Example A comprising example A detergent composition was within the scope of the present invention.

Premature Rupture Release Test Method:

This test method describes the practice for determining the sensitivity of a liquid detergent composition towards running out of a unit dose article comprising a pinhole upon applied pressure, using the Instron Universal Materials Testing instrument (Instron Industrial Products, 825 University Ave., Norwood, Mass. 02062-2643) with a load cell of maximum 100 kN (kilo Newton). Through compression of a unit dose article for a set time period (3 seconds) at a constant pressure (100N), this method gravimetrically determines the overall amount of liquid detergent composition that ran out of the unit dose article by weighing the unit dose article before and after the applied pressure.

The test is conducted no sooner than two weeks after unit dose article production so that the film/unit dose have time to set after converting. The method is performed in a room environment between 40-50% relative humidity (RH) and 22-24° C. Unit dose articles are allowed to equilibrate to the testing room environment for one hour prior to testing. Just prior to testing a pinhole is manually applied at the side of the unit dose article under the seal area with a needle having a diameter of 1 mm.

FIG. 1 depicts a schematic illustration of the basic configuration of the liquid detergent release test. To measure amount of liquid detergent released from a unit dose article comprising a pinhole, a reference unit dose article and a test unit dose article 510 are placed between two compression plates 520, 530 of the instrument. The pin hole 511 side walls of the unit dose articles are not covered by the plates to allow the liquid detergent to freely exit the unit dose article. The unit dose articles 510 are placed as such that the plain encompassing the seal flange areas 540 are located horizontally and perpendicular to the force direction applied by the compression plates (x-direction). For mono-compartment and side by side multi-compartment unit dose articles the deformed film enabling a cavity to dose the detergent into touches the bottom compression plate while the closing film will touch the upper compression plate. For side by side multi-compartment unit dose articles all individual compartments comprising liquid detergent are punctured right under the seal area, as described above. For superposed unit dose articles the largest volume will be in contact with the bottom compression plate and will be the one punctured. For the compression, the speed of decreasing the distance between the plates 520 and 530 is set at 150 mm/min until a pressure of 100N is reached on the unit dose article and maintained for 3 seconds after which the pressure is released. The unit dose articles are weighed before and after the pressure application, the delta weight in grams corresponding to the amount of detergent composition run out of the unit dose article. Three replicates are conducted per test leg, and average detergent composition loss values are reported.

Results:

TABLE 2

| Reference | | | Example A | | | Delta versus Reference Delta |
|---|---|---|---|---|---|---|
| Start weight [g] | End weight [g] | Delta [g] | Start weight [g] | End weight [g] | Delta [g] | (Delta [g]) vs ref [g] |
| 38.31 | 34.58 | −3.73 | 38.14 | 36.32 | −1.82 | −1.91 |

From the data in Table 2 it is clear that single variable addition of the amphoteric surfactant (AO) according to the invention (Example A) leads to less liquid running out of a pinholed water soluble unit dose article upon applied pressure compared to a reference liquid not comprising the amphoteric surfactant according to the invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of washing a fabric, the method comprising the steps of;

a. providing a water-soluble unit dose article, the water-soluble unit dose article comprising a water-soluble film and a liquid laundry detergent composition, wherein the liquid laundry detergent composition comprises;
   i) a non-soap anionic surfactant;
   ii) an amphoteric surfactant; and
   iii) a cyclic diamine, wherein the cyclic diamine is selected from the group consisting of 2-methylcyclohexane-1,3-diamine; 4-methylcyclohexane-1,3-diamine; and mixtures thereof;
b. adding the water-soluble unit dose article to sufficient water to dilute the liquid laundry detergent composition to create a wash liquor; and
c. contacting fabric to be washed with the wash liquor; wherein the article is used in an automatic fabric wash operation.

2. The method according to claim 1 wherein the amphoteric surfactant is amine oxide, wherein the amine oxide is selected from $C_{12-14}$ dimethyl amine oxide or $C_{12-14}$ amido propyl dimethyl amine oxide.

3. The method according to claim 1 wherein the liquid laundry detergent composition comprises from about 0.01% to about 20 by weight of the liquid detergent composition of the amphoteric surfactant.

4. The method according to claim 1 wherein the non-soap anionic surfactant is selected from the group consisting of linear alkylbenzene sulphonate, alkyl sulphate, alkoxylated alkyl sulphate or a mixture thereof.

5. The method according to claim 4 wherein the non-soap anionic surfactant comprises linear alkylbenzene sulphonate and alkoxylated alkyl sulphate and the weight ratio of linear alkylbenzene sulphonate to alkoxylated alkyl sulphate is from about 2:1 to about 1:8.

6. The method according to claim 4 comprising between about 5% and about 45%, by weight of the liquid detergent composition of the non-soap anionic surfactant.

7. The method according to claim 1 wherein the liquid laundry detergent composition further comprises a non-ionic surfactant.

8. The method according to claim 7 wherein the non-ionic surfactant is selected from the group consisting of a fatty alcohol alkoxylate, an oxo-synthesised fatty alcohol alkoxylate, Guerbet alcohol alkoxylates, alkyl phenol alcohol alkoxylates or a mixture thereof.

9. The method according to claim 7 wherein the liquid laundry detergent composition comprises between about 1% and about 25% by weight of the liquid laundry detergent composition of the non-ionic surfactant.

10. The method according to claim 1 wherein the liquid detergent composition further comprises between about 1% and about 25 by weight of the liquid detergent composition of soap.

11. The method according to claim 1 wherein the water-soluble film is a polymeric water-soluble film, wherein the polymeric film comprises polyvinyl alcohol.

12. The method according to claim 1 further comprising an adjunct ingredient selected from the group consisting of hueing dyes, polymers, builders, dye transfer inhibiting agents, dispersants, enzymes, enzyme stabilizers, catalytic materials, bleach, bleach activators, polymeric dispersing agents, anti-redeposition agents, suds suppressors, aesthetic dyes, opacifiers, perfumes, perfume delivery systems, structurants, hydrotropes, processing aids, pigments and mixtures thereof.

13. The method according to claim 1 wherein the liquid detergent composition has a viscosity of at least about 2 Pa·s at a shear rate of about 0.5 $s^{-1}$ as measured using a TA Rheometer AR2000 at about 25° C.

14. A method according to claim 1, wherein the water-soluble unit dose article is added to sufficient water to dilute the liquid laundry detergent composition by a factor of at least 300-fold to create the wash liquor.

* * * * *